US010557445B2

(12) United States Patent
Arihara et al.

(10) Patent No.: US 10,557,445 B2
(45) Date of Patent: Feb. 11, 2020

(54) HIGH-PRESSURE FUEL SUPPLY DEVICE FOR INTERNAL COMBUSTION ENGINE

(71) Applicant: Hitachi Automotive Systems, Ltd., Hitachinaka-shi, Ibaraki (JP)

(72) Inventors: Yoshinobu Arihara, Hitachinaka (JP); Takashi Okamoto, Hitachinaka (JP)

(73) Assignee: Hitachi Automotive Systems, Ltd, Hitachinaka-shi (JP)

( * ) Notice: Subject to any disclaimer, the term of this patent is extended or adjusted under 35 U.S.C. 154(b) by 0 days.

(21) Appl. No.: 15/536,689

(22) PCT Filed: Jan. 12, 2016

(86) PCT No.: PCT/JP2016/050601
§ 371 (c)(1),
(2) Date: Jun. 16, 2017

(87) PCT Pub. No.: WO2016/117400
PCT Pub. Date: Jul. 28, 2016

(65) Prior Publication Data

US 2017/0342935 A1 Nov. 30, 2017

(30) Foreign Application Priority Data

Jan. 21, 2015 (JP) ..... 2015-009782

(51) Int. Cl.
*F02D 41/38* (2006.01)
*F02M 59/36* (2006.01)
(Continued)

(52) U.S. Cl.
CPC ..... *F02M 59/368* (2013.01); *F02D 41/20* (2013.01); *F02D 41/38* (2013.01);
(Continued)

(58) Field of Classification Search
CPC ..... F02D 2041/2034; F02D 2041/2037; F02D 2041/2055; F02M 59/366; F02M 59/367; F02M 59/368
See application file for complete search history.

(56) References Cited

U.S. PATENT DOCUMENTS 8,677,977 B2 * 3/2014 Furuhashi ..... F02D 41/08 123/501
9,026,342 B2 * 5/2015 Kemmer ..... F02D 41/38 123/478
(Continued)

FOREIGN PATENT DOCUMENTS

JP 2000-8997 A 1/2000
JP 2009-203987 A 9/2009
(Continued)

OTHER PUBLICATIONS

International Search Report (PCT/ISA/210) issued in PCT Application No. PCT/JP2016/050601 dated Apr. 12, 2016 with English translation (5 pages).
(Continued)

*Primary Examiner* — Kevin R Steckbauer
(74) *Attorney, Agent, or Firm* — Crowell & Moring LLP

(57) ABSTRACT

Provided is a high-pressure fuel supply device for an internal combustion engine, said device being capable of suppressing noise from collisions of a plunger rod and an air intake valve. A high-pressure fuel pump 108 comprises an intake valve, a plunger rod that is formed as a separate element from the intake valve, an elastic member that biases the plunger rod in the valve-opening direction of the intake valve, and a solenoid that draws the plunger rod in the valve-closing direction of the intake valve when supplied with electricity. A control device 101 has a first control unit that applies a first current to the solenoid in order to close the intake valve, and a second control unit that applies a second
(Continued)

current to the solenoid before the plunger rod collides with the intake valve due to the biasing force of the elastic member.

10 Claims, 10 Drawing Sheets

(51) Int. Cl.
*F02M 51/06* (2006.01)
*F02M 63/00* (2006.01)
*F02M 63/02* (2006.01)
*F02M 59/46* (2006.01)
*F02D 41/20* (2006.01)

(52) U.S. Cl.
CPC ..... *F02D 41/3845* (2013.01); *F02M 51/061* (2013.01); *F02M 59/466* (2013.01); *F02M 63/0017* (2013.01); *F02M 63/0031* (2013.01); *F02M 63/0225* (2013.01); *F02M 2200/09* (2013.01)

(56) References Cited

U.S. PATENT DOCUMENTS 9,121,360 B2 * 9/2015 Richter ..... F02D 41/20
9,273,625 B2 * 3/2016 Borg ..... F02D 41/20
9,341,181 B2 * 5/2016 Sakamoto ..... F04B 49/22
9,435,334 B2 * 9/2016 Furuhashi ..... F02D 41/08
9,435,335 B2 * 9/2016 Furuhashi ..... F02D 41/08
9,683,509 B2 * 6/2017 Maess ..... F02D 41/20
9,714,632 B2 * 7/2017 Maess ..... F02D 41/20
9,726,104 B2 * 8/2017 Tokuo ..... F02D 41/20
9,926,878 B2 * 3/2018 Suzuki ..... F02D 41/3082
9,945,373 B2 * 4/2018 Furuhashi ..... F02D 41/08
10,151,267 B2 * 12/2018 Anetsberger ..... F02M 59/022
10,161,342 B2 * 12/2018 Natori ..... F02D 41/20
2010/0237266 A1 * 9/2010 Haaf ..... F02D 41/20
251/129.15
2011/0265765 A1 * 11/2011 Furuhashi ..... F02D 41/08
123/446
2011/0288748 A1 * 11/2011 Richter ..... F02D 41/20
701/103
2012/0118271 A1 * 5/2012 Borg ..... F02D 41/20
123/495
2012/0166069 A1 * 6/2012 Kemmer ..... F02D 41/20
701/105
2013/0032212 A1 * 2/2013 Tokuo ..... F02D 41/20
137/1
2013/0243608 A1 * 9/2013 Sakamoto ..... F04B 49/22
417/26
2014/0161631 A1 * 6/2014 Furuhashi ..... F02D 41/08
417/44.1
2014/0161634 A1 * 6/2014 Furuhashi ..... F02D 41/08
417/53
2015/0159575 A1 * 6/2015 Maess ..... F02D 41/20
137/1
2016/0076501 A1 * 3/2016 Maess ..... F02D 41/20
123/458
2016/0305418 A1 * 10/2016 Furuhashi ..... F02D 41/08
2017/0089291 A1 * 3/2017 Suzuki ..... F02D 41/3082
2017/0107931 A1 * 4/2017 Anetsberger ..... F02M 59/022
2017/0211558 A1 * 7/2017 Zhang ..... F02D 41/3082
2017/0284389 A1 * 10/2017 Fukuda ..... F04B 53/001
2018/0156152 A1 * 6/2018 Natori ..... F02D 41/20

FOREIGN PATENT DOCUMENTS

JP 2010-14109 A 1/2010
JP 2012-246852 A 12/2012
JP 2013-32750 A 2/2013
JP 2014-145339 A 8/2014
JP 2014-211168 A 11/2014
WO WO 2014/005859 A1 1/2014

OTHER PUBLICATIONS

Japanese-language Written Opinion (PCT/ISA/237) issued in PCT Application No. PCT/JP2016/050601 dated Apr. 12, 2016 (4 pages).

* cited by examiner

HIGH-PRESSURE FUEL SUPPLY DEVICE FOR INTERNAL COMBUSTION ENGINE

TECHNICAL FIELD

The present invention relates to a high-pressure fuel supply device for an internal combustion engine.

BACKGROUND ART

From the viewpoint of environmental conservation, current automobiles are required to reduce the emission gas substances such as carbon monoxide (CO), hydrocarbon (HC), nitrogen oxide (NOx) contained in the exhaust gas of automobiles and cylinder fuel injection type internal combustion engines for the purpose of reducing these substances are widely known. The cylinder fuel injection type internal combustion engine directly injects fuel into a combustion chamber of a cylinder with a fuel injection valve, and by reducing the particle diameter of fuel injected from the fuel injection valve, combustion of the injected fuel is promoted to reduce the amount of exhaust gas substances and to improve the engine output and the like.

In order to reduce the particle size of the fuel injected from the fuel injection valve, measures for increasing the pressure of the fuel are necessary, and various technologies of a high-pressure fuel pump for pumping high pressure fuel to the fuel injection valve is proposed.

For example, known is a technique of reducing the driving force of the high-pressure fuel pump by controlling the flow rate of the high pressure fuel supplied in accordance with the fuel injection amount of the fuel injection valve (see, for example, PTL 1). PTL 1 describes two types of electromagnetic valves, namely a normally open type and a normally closed type, as the flow rate control mechanism, but in either case, the volume of the fuel pressurized by the high-pressure fuel pump is adjusted by controlling the timing at which the intake valve closes during the discharge process.

An intake valve of the high-pressure fuel pump is controlled with an electromagnetic valve between the open position and the closed position, and known is a technique in which the current driving the electromagnetic valve is changed in two stages when the intake valve is controlled from the open position to the closed position (see, for example, PTL 2). According to the technique of PTL 2, the operation sound (the impact sound of the intake valve) is suppressed by reducing the current value before the completion of the movement of the intake valve to the closed position with respect to the current at the time of starting energization so as to lower the moving speed of the intake valve.

Furthermore, a technique is known for controlling the amount of fuel fed under high pressure from a high-pressure fuel pump by using the timing of energizing an electromagnetic valve (see, for example, PTL 3). In the technique of PTL 3, when the electromagnetic valve is supplied with electricity during the compression process of the high-pressure fuel pump, the plunger rod moves away from the intake valve, and the intake valve moves to the closed position by the spring force and the fuel pressure. Since the pressure in the pressurizing chamber is high after the intake valve is closed, even when the electromagnetic valve is deenergized and the plunger rod is pressed against the intake valve, the intake valve is held in the closed position. When the piston plunger moves toward the bottom dead center and the pressure in the pressurizing chamber decreases, the plunger rod and the intake valve move in the opening direction.

CITATION LIST

Patent Literature

PTL 1: Publication of Patent No. 2000-8997
PTL 2: Publication of Patent No. 2010-14109
PTL 3: Publication of Patent No. 2009-203987

SUMMARY OF INVENTION

Technical Problem

In the high-pressure fuel pump disclosed in PTL 3, the plunger rod and the intake valve are separately provided. Therefore, noise is generated when the plunger rod collides with the intake valve.

On the other hand, in the high-pressure fuel pump disclosed in PTLs 1 and 2, a plunger rod and an intake valve are integrally provided. Accordingly, no consideration is given to the noise when the plunger rod and the intake valve collide with each other.

An object of the present invention is to provide a high-pressure fuel supply device for an internal combustion engine that can suppress noise when a plunger rod and an intake valve collide with each other.

Solution to Problem

In order to solve the above issue, the present invention includes: a high-pressure fuel pump including an intake valve, a plunger rod which is formed as a separate element from the intake valve, an elastic member which biases the plunger rod in a valve-opening direction of the intake valve, and a solenoid which draws the plunger rod in a valve-closing direction of the intake valve when supplied with electricity; and a control device including a first control unit which applies a first current to the solenoid to close the intake valve, and a second control unit which applies a second current to the solenoid before the plunger rod collides with the intake valve due to biasing force of the elastic member.

Advantageous Effects of Invention

According to the present invention, noise can be suppressed when the plunger rod and the intake valve collide with each other. The problems, configurations, and effects other than those described above will be clarified by the description of embodiments below.

DESCRIPTION OF EMBODIMENTS

Figure 1:
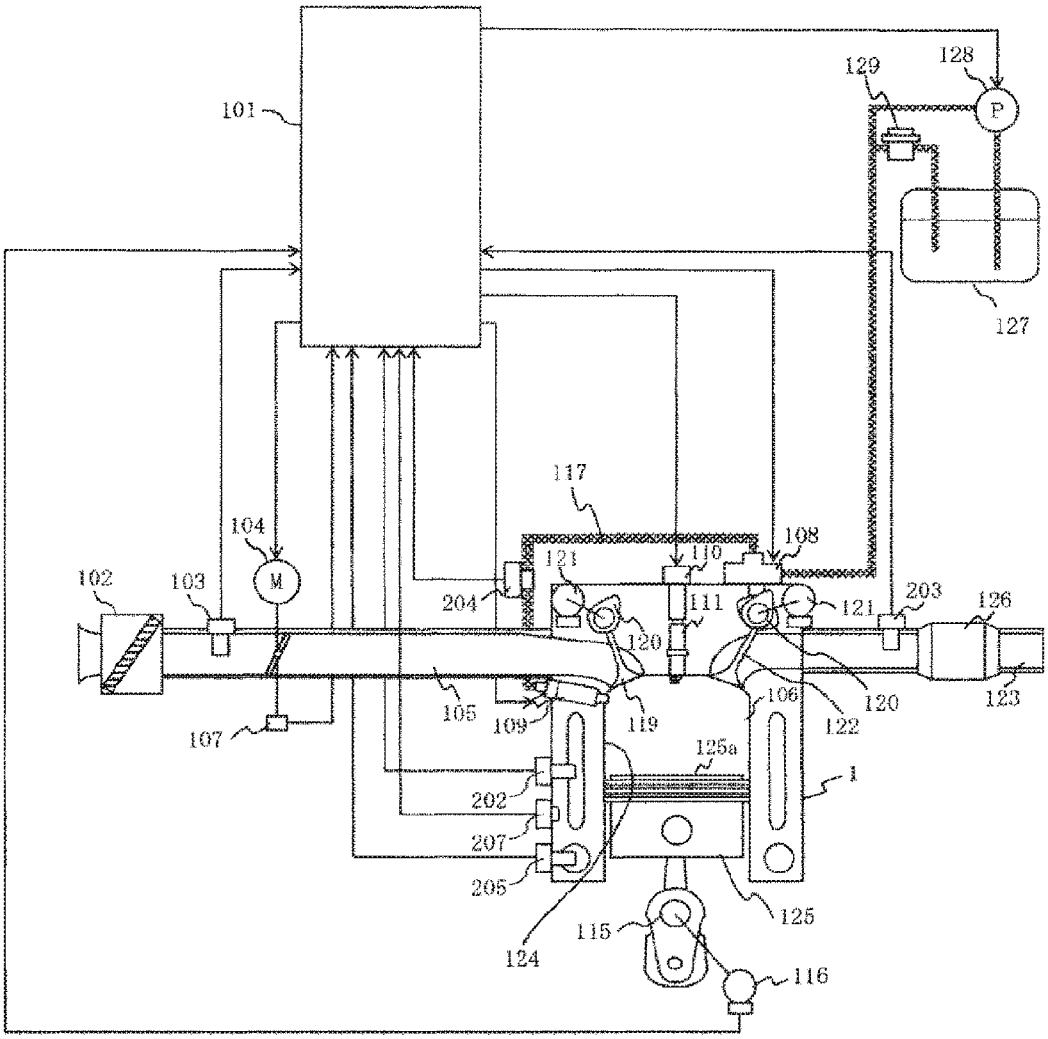
FIG. 1 is a schematic diagram showing an overall configuration of a control system including a high-pressure fuel supply device for an internal combustion engine according to an embodiment of the present invention.

Hereinafter, the configuration and operation of a control system including a high-pressure fuel supply device for an internal combustion engine according to an embodiment of the present invention will be described with reference to the drawings. In each drawing, the same reference numerals denote the same parts.

First, the configuration of the high-pressure fuel supply device will be described with reference to FIG. 1. FIG. 1 is a schematic diagram showing an overall configuration of a control system including a high-pressure fuel supply device for an internal combustion engine according to an embodiment of the present invention.

The intake air taken in from the inlet portion of an air cleaner 102 passes through a flow rate measuring section in which an intake air flow meter (air flow sensor) 103 is disposed, and its flow rate is measured. Thereafter, the intake air is distributed to intake pipes 105 connected to respective cylinders 124 through an electrically controlled throttle valve 104 controlling the intake air flow rate. The intake air is distributed to the intake pipes 105 and then introduced into a combustion chamber 106 through an intake valve 119 provided in each cylinder.

The combustion chamber 106 is formed by the inner wall surface of the cylinder 124 and a crown surface 125*a* of a piston 125 reciprocating in the cylinder 124, and its volume is changed by the reciprocating motion of the piston 125. From the intake air flow meter 103, an output signal representing the intake air flow rate is input to an internal combustion engine control unit (electronic control unit: ECU) 101 that is a control device. A throttle opening degree sensor 107 for detecting the opening degree of the electrically controlled throttle valve 104 is attached to the electrically controlled throttle valve 104, and an output signal thereof is also input to the internal combustion engine control unit 101.

After being primarily pressurized by a low-pressure fuel pump 128 from a fuel tank 127, the fuel is regulated to a constant pressure by a pressure regulator 129, and secondarily pressurized to a higher pressure by a high-pressure fuel pump 108, and then is injected from a fuel injection valve 109 (injector) provided in each cylinder into the combustion chamber 106 via a common rail 117. The fuel injected into the combustion chamber 106 generates an air-fuel mixture with the intake air, and is ignited with an ignition plug 111 by the ignition energy from an ignition coil 110, thereby burning in the combustion chamber 106.

The exhaust gas generated by the combustion of the air-fuel mixture is discharged from the combustion chamber 106 to an exhaust pipe 123 through an exhaust valve 122 provided in each cylinder. An air-fuel ratio sensor 203 and a catalyst 126 are provided on the exhaust pipe 123. The air-fuel ratio sensor output signal of the exhaust gas detected by the air-fuel ratio sensor 203 is input to the internal combustion engine control unit (ECU) 101.

The feedback control is executed from the internal combustion engine control unit (ECU) 101 to the fuel injection valve 109 so as to achieve a predetermined air-fuel ratio on the basis of the output signal of the air-fuel ratio sensor. The air-fuel ratio sensor 203 employs an O2 sensor whose output voltage changes suddenly in the vicinity of the theoretical air-fuel ratio, or an A/F sensor that detects an actual air-fuel ratio.

The catalyst 126 is constituted by a three-way catalyst, and the exhaust gas is purified. In order to exhibit the purifying action of the catalyst 126, the activation temperature needs to be reached, and control is executed to bring the catalyst into the warming state early by the internal combustion engine control unit (ECU). For this purpose, it is necessary to detect the catalyst temperature state, and the detection is executed by using estimation by the intake air amount integrated value from the intake air flow meter (air flow sensor) 103, substitution with a water temperature sensor 202 or an oil temperature sensor 205, detection of a direct catalyst temperature sensor (not shown) or the like.

A knock sensor 207 for detecting knocking that occurs during combustion is provided on the side surface of the engine 1 and outputs a detection signal to the internal combustion engine control unit 101.

A crank angle sensor 116 attached to a crankshaft 115 of the engine 1 outputs a signal indicating the rotational position of the crankshaft 115 to the internal combustion engine control unit 101.

A cam angle sensor 121 attached to a camshaft 120 of the internal combustion engine outputs a signal indicating the rotational position of the camshaft to the internal combustion engine control unit 101. The camshaft 120 and the cam angle sensor 121 are provided for each of the intake valve 119 and the exhaust valve 122.

Figure 2:
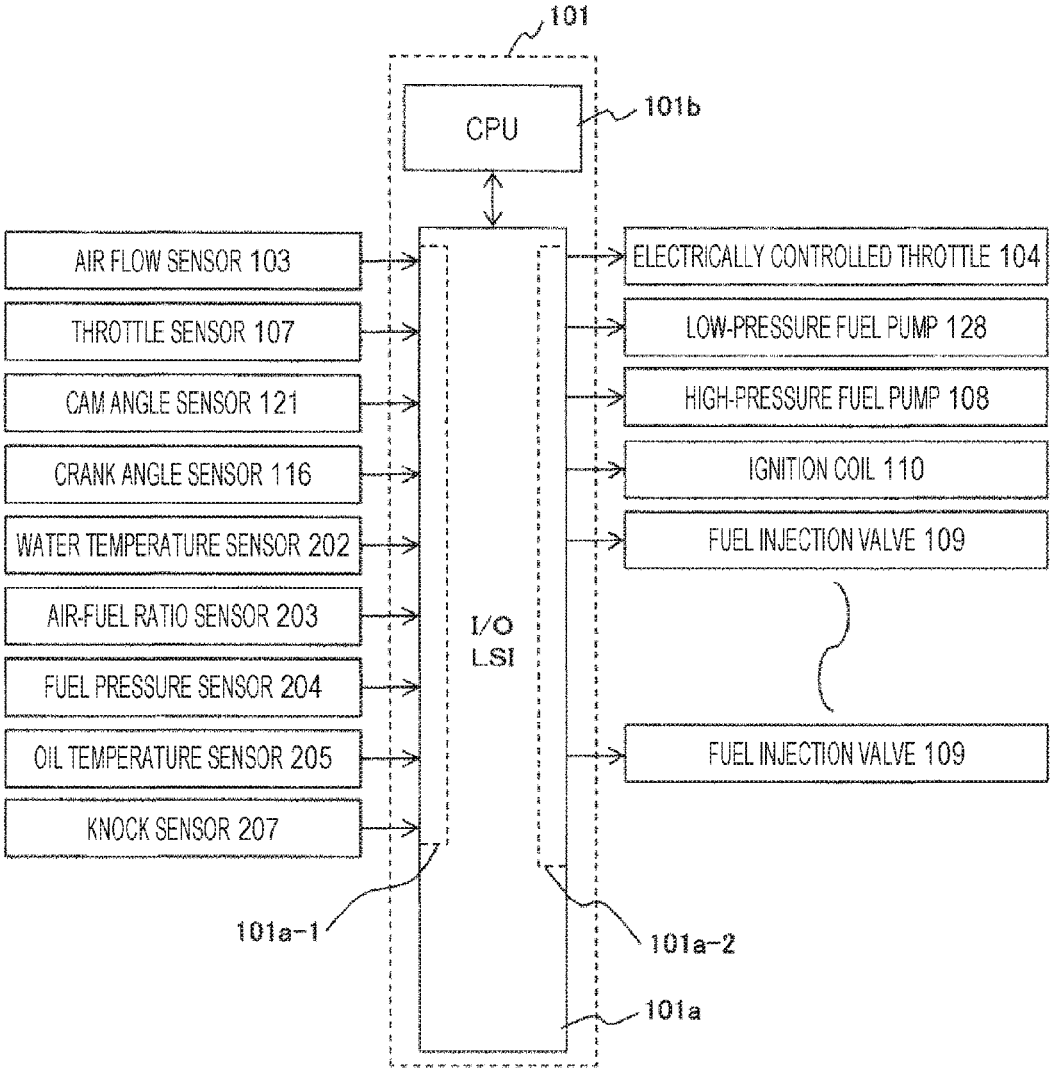
FIG. 2 is a diagram showing an example of an input-output relationship of the internal combustion engine control unit shown in FIG. 1.

Next, with reference to FIG. 2, the input-output relationship of the internal combustion engine control unit 101 will be described. FIG. 2 is a diagram showing an example of the input-output relationship of the internal combustion engine control unit 101 shown in FIG. 1.

The internal combustion engine control unit 101 is composed of an LSI 101*a* for I/O including an A/D converter 101*a*-1, a central processing unit (CPU) 101*b* for executing arithmetic processing, and the like. The internal combustion engine control unit 101 receives signals as input, such as signals of various sensors including the air flow sensor 103, the throttle sensor 107, the cam angle sensor 121, the crank angle sensor 116, the water temperature sensor 202, the air-fuel ratio sensor 203, a fuel pressure sensor 204, the oil temperature sensor 205, the knock sensor 207, and executes a predetermined arithmetic processes.

Control signals are output to the electrically controlled throttle valve 104, the low-pressure fuel pump 128, the high-pressure fuel pump 108, the ignition coil 110, and a plurality of fuel injection valves 109, which are actuators, according to the calculated arithmetic results and the common rail internal combustion pressure control, fuel injection quantity control, ignition timing control and the like are executed.

The LSI 101*a* for I/O is provided with a drive circuit 101*a*-2 for driving each of the fuel injection valves 109. The drive circuit 101*a*-2 boosts the voltage supplied from the battery with a boosting circuit (not shown), controls the current with an integrated circuit (IC) (not shown), and drives each of the fuel injection valves 109 with the controlled current.

Figure 3:
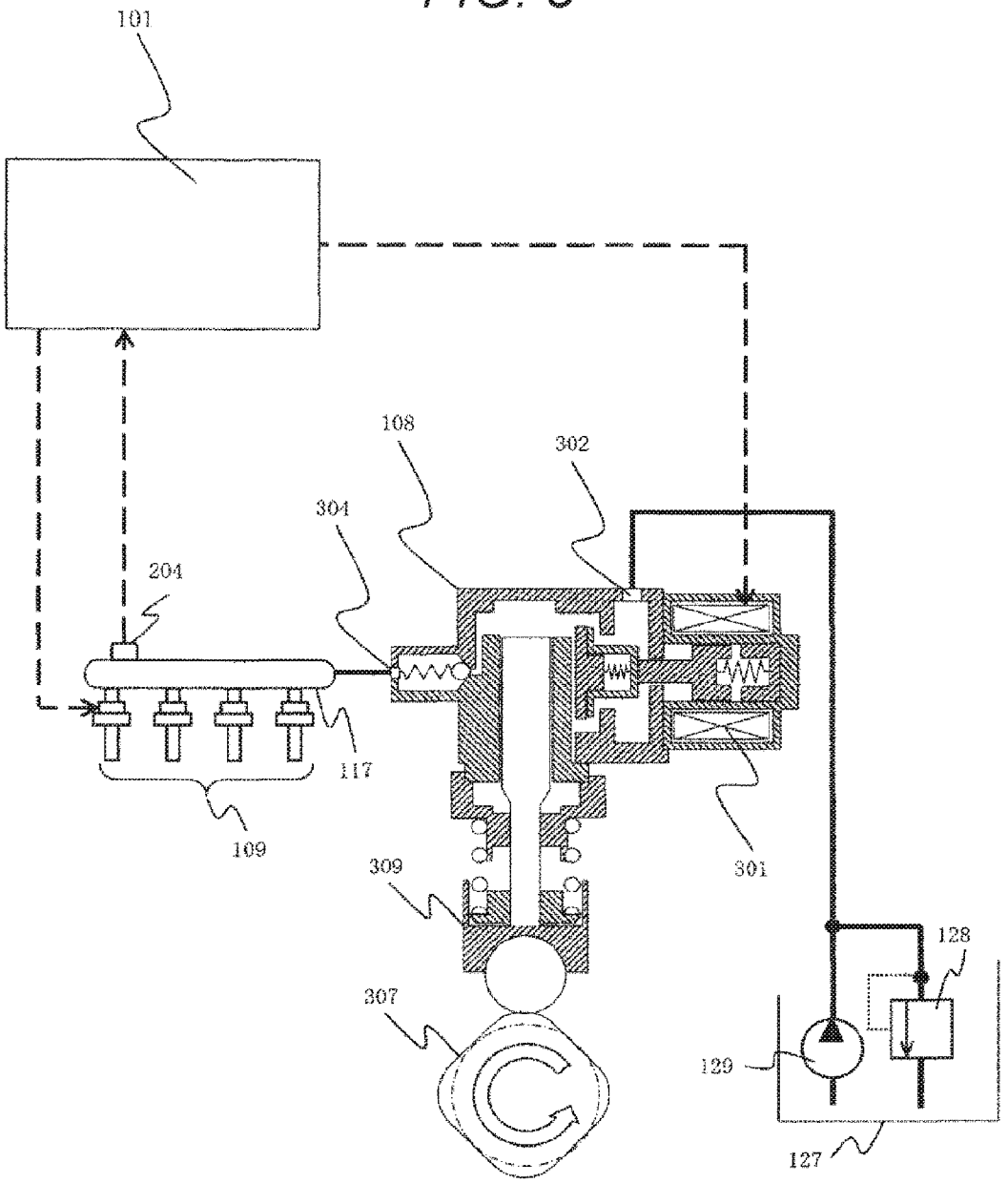
FIG. 3 is an overall configuration diagram of a fuel system including the high-pressure fuel pump shown in FIG. 1.
Figure 4:
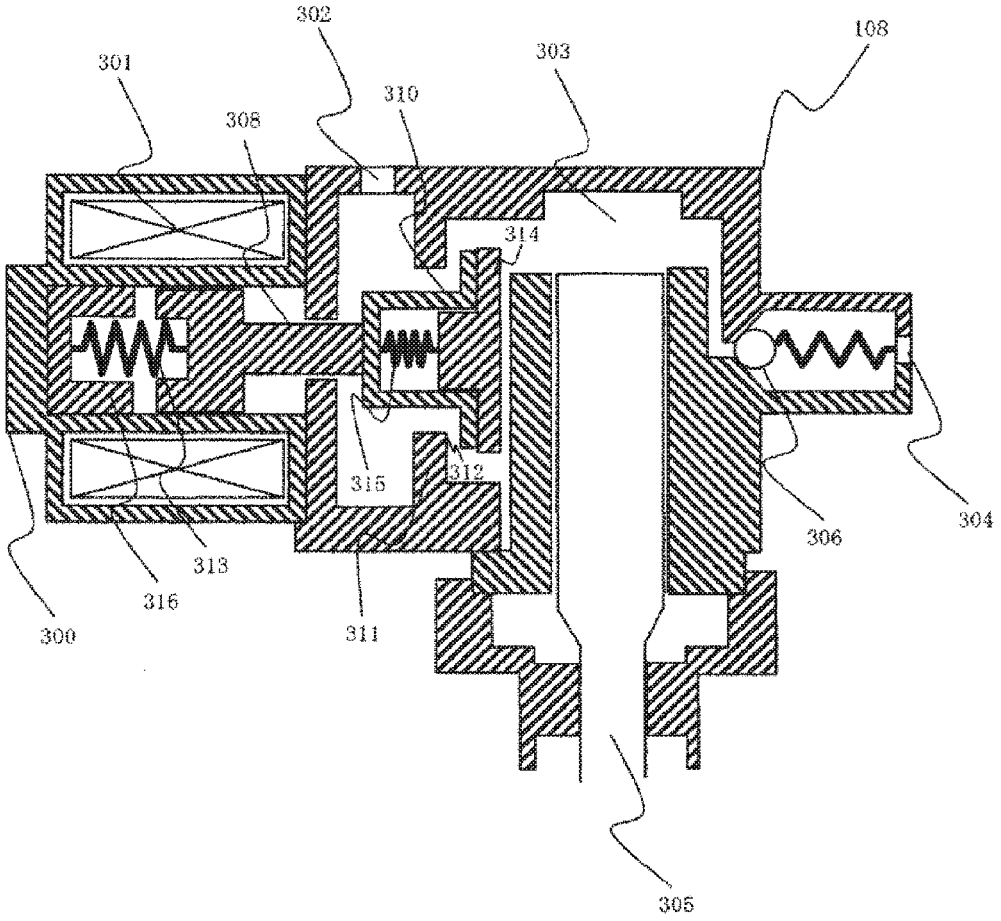
FIG. 4 is a cross-sectional view of the high-pressure fuel pump shown in FIG. 3.

Next, the configuration of the high-pressure fuel pump 108 will be described with reference to FIGS. 3 to 4. FIG. 3 is an overall configuration diagram of a fuel system including the high-pressure fuel pump 108 shown in FIG. 1. FIG. 4 is a cross-sectional view of the high-pressure fuel pump 108 shown in FIG. 3.

The fuel is sucked by the low-pressure fuel pump 128 from the tank 127, and is regulated to a constant pressure by the pressure regulator 129, and then guided to a fuel intake port 302 of the high-pressure fuel pump 108. Thereafter, the fuel is pressurized to a high pressure by the high-pressure fuel pump 108 and fed under pressure from a fuel discharge port 304 to the common rail 117. The fuel injection valve 109 and the fuel pressure sensor 204 are mounted on the common rail 117.

The injector 109 is mounted according to the number of cylinders of the engine, and injects fuel in accordance with the drive current supplied from the internal combustion engine control unit 101. The fuel pressure sensor 204 outputs the acquired fuel pressure data to the internal combustion engine control unit 101. The internal combustion engine control unit 101 calculates an appropriate injection fuel quantity, fuel pressure and the like on the basis of the engine state quantity (for example, crank rotation angle, throttle opening, engine speed, fuel pressure, etc.) obtained from various sensors, and controls the high-pressure fuel pump 108 and the fuel injection valve 109.

The high-pressure fuel pump 108 pressurizes the fuel from the fuel tank 127 and feeds under pressure, the high pressure fuel to the common rail 117. The fuel intake port 302, the fuel discharge port 304, and a fuel pressurizing chamber 303 are formed in the high-pressure fuel pump 108. A piston plunger 305 as a pressurizing member is slidably held in the fuel pressurizing chamber 303. The fuel discharge port 304 is provided with a fuel discharge valve 306 in order to prevent the high pressure fuel on the downstream side from flowing back to the pressurizing chamber.

A fuel intake valve 310 for controlling intake of fuel is provided downstream of the fuel intake port 302. The fuel intake valve 310 opens when the electromagnetic valve solenoid 301 is deenergized, and closes when the electromagnetic valve solenoid 301 is energized.

The piston plunger 305 reciprocates via a lifter 309 pressed against a pump drive cam 307 which rotates in accordance with the rotation of the camshaft 120 of the exhaust valve 122 in the engine 1 and changes the volume of the fuel pressurizing chamber 303.

In an electromagnetic valve 300, when the electromagnetic valve solenoid 301 is supplied with electricity, a plunger rod 308 is electromagnetically driven. That is, at the time of energization, the plunger rod 308 is magnetically drawn in the valve-closing direction of the fuel intake valve 310 (left direction in FIG. 4).

The fuel intake valve 310 is provided next to the plunger rod 308. The plunger rod 308 is formed separately from the fuel intake valve 310. The flange portion formed on the fuel intake valve 310 faces a valve seat 312 formed in a valve housing 311.

A plunger rod biasing spring 313 is provided at the other end of the plunger rod 308 and biases the plunger rod 308 in the direction in which the fuel intake valve 310 separates from the valve seat 312. In other words, the plunger rod biasing spring 313 (elastic member) biases the plunger rod 308 in the valve-opening direction of the fuel intake valve 310 (right direction in FIG. 4). The fuel intake valve 310 is held reciprocably between the valve seat 312 and a valve stopper 314.

A fuel intake valve biasing spring 315 is disposed between the fuel intake valve 310 and the valve stopper 314. The fuel intake valve 310 is biased in a direction away from the valve stopper 314 by the fuel intake valve biasing spring 315. Although the fuel intake valve 310 and the tip of the plunger rod 308 are biased by the respective springs in opposite directions to each other, the plunger rod biasing spring 313 is constituted by a stronger spring.

Accordingly, the plunger rod 308 presses the fuel intake valve 310 in a direction away from the valve seat against the force of the intake valve biasing spring 315, and as a result, presses the fuel intake valve 310 against the valve stopper 314.

When the electromagnetic valve solenoid 301 is not supplied with electricity, the plunger rod 308 is biased in the direction to open the fuel intake valve 310 by the plunger rod biasing spring 313 via the plunger rod 308, and the fuel intake valve 310 is kept at the opened position.

Figure 5:
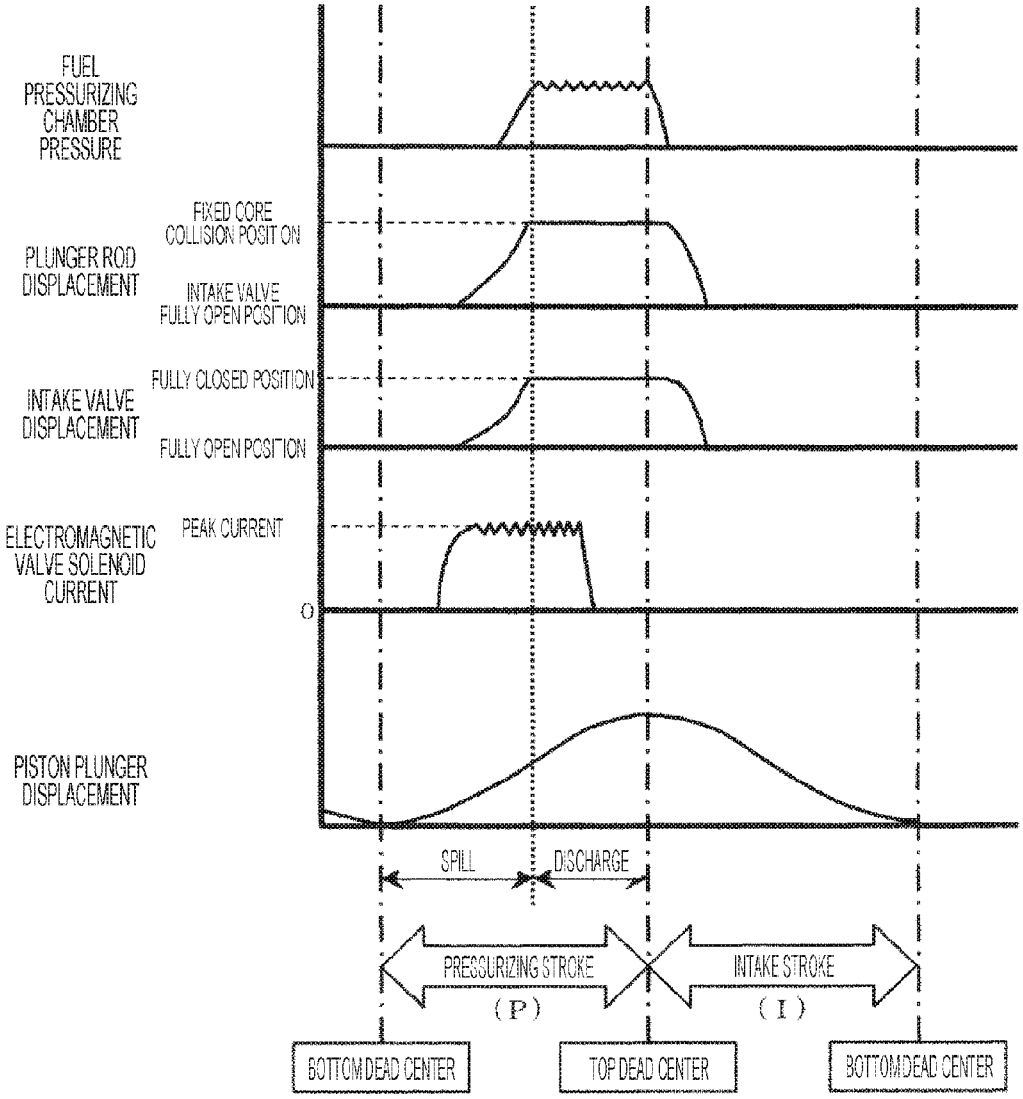
FIG. 5 is an operation timing chart of the high-pressure fuel pump shown in FIG. 3.

Next, with reference to FIGS. 5 to 6, the basic operation of the high-pressure fuel pump 108 will be described. FIG. 5 is an operation timing chart of the high-pressure fuel pump 108 shown in FIG. 3. FIGS. 6A to 6C are schematic views showing the operation of the plunger rod 308 and the fuel intake valve 310 of the high-pressure fuel pump 108 shown in FIG. 3.

Figure 6A:
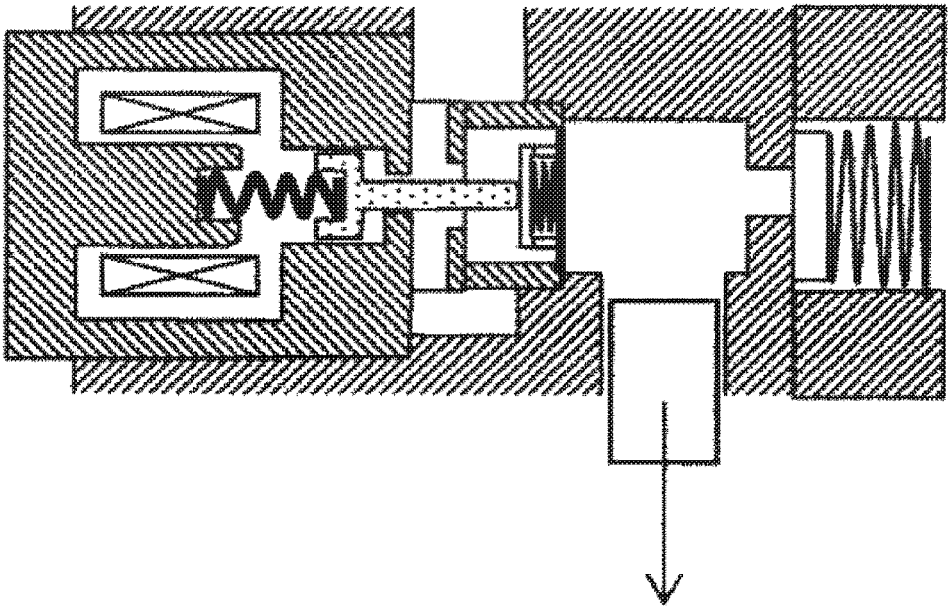
FIG. 6A is a schematic diagram showing an operation of a plunger rod and a fuel intake valve of the high-pressure fuel pump shown in FIG. 3.

In the state of the intake stroke (I) of FIG. 5, the volume of the fuel pressurizing chamber 303 increases as the piston plunger 305 descends as shown in FIG. 6A. At this time, since the fuel intake valve 310 is open, fuel flows into the fuel pressurizing chamber 303 from the fuel intake port 302.

Figure 6B:
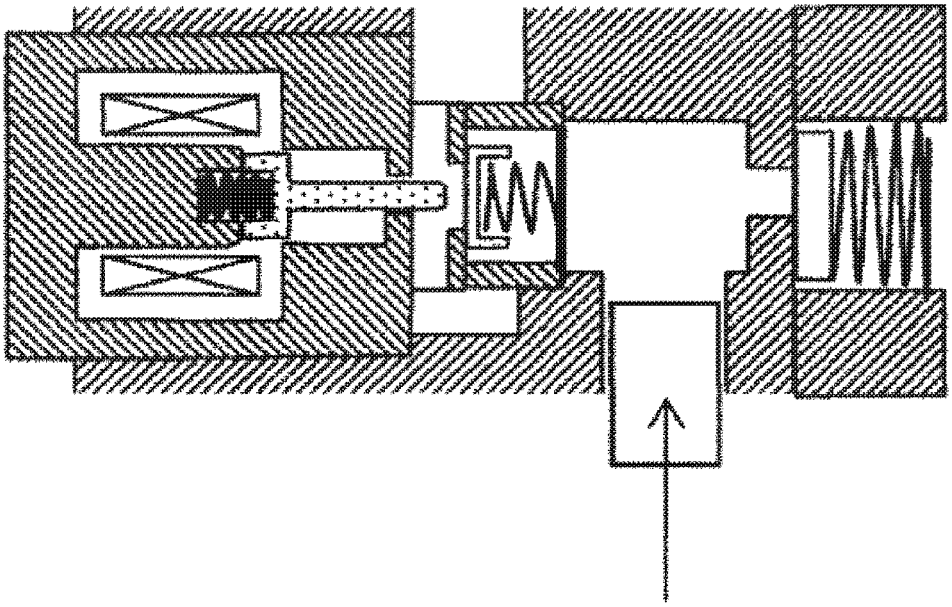
FIG. 6B is a schematic diagram showing the operation of the plunger rod and the fuel intake valve of the high-pressure fuel pump shown in FIG. 3.
Figure 6C:
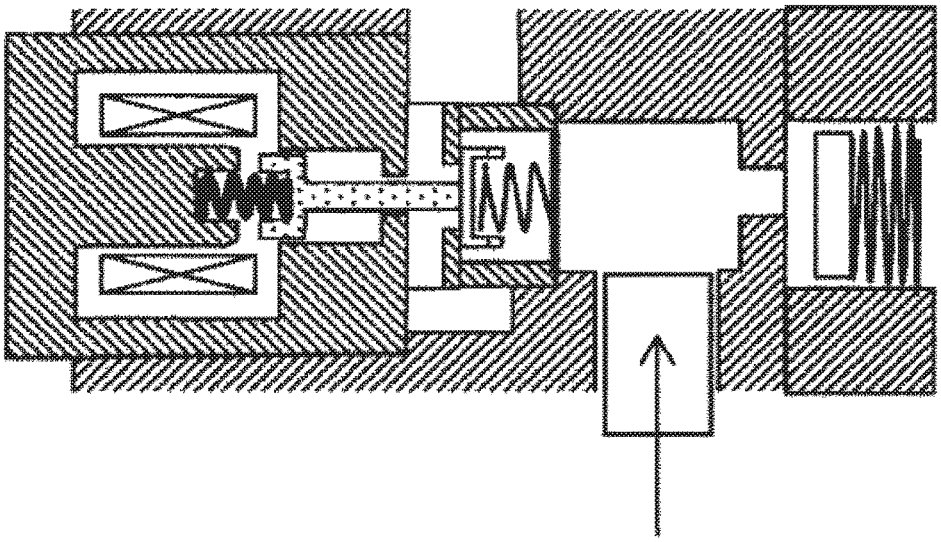
FIG. 6C is a schematic diagram showing the operation of the plunger rod and the fuel intake valve of the high-pressure fuel pump shown in FIG. 3.

In the state of the pressurizing step (P) in FIG. 5, as shown in FIG. 6B, when the fuel intake valve 310 closes with the ascent of the piston plunger 305, the fuel in the fuel pressurizing chamber 303 is pressurized and passes through the fuel discharge valve 306, being discharged to the common rail 117 as shown in FIG. 6C. When the fuel intake valve 310 is open during this pressurizing step, the fuel spills (overflows) toward the fuel intake port 302 during that time, and the fuel in the fuel pressurizing chamber 303 is not discharged toward the common rail 117.

In this manner, the fuel discharge of the high-pressure fuel pump 108 is operated by opening and closing the fuel intake valve 310, and the opening and closing of the fuel intake valve 310 is operated by energizing/deenergizing the electromagnetic valve solenoid 301 by the internal combustion engine control unit 101.

Further, on the basis of the signal of the fuel pressure sensor 204, the internal combustion engine control unit 101 calculates an appropriate energization timing to control the electromagnetic valve solenoid 301. Thereby, the fuel pressure in the common rail 117 can be subjected to feedback control to the target value.

Figure 7:
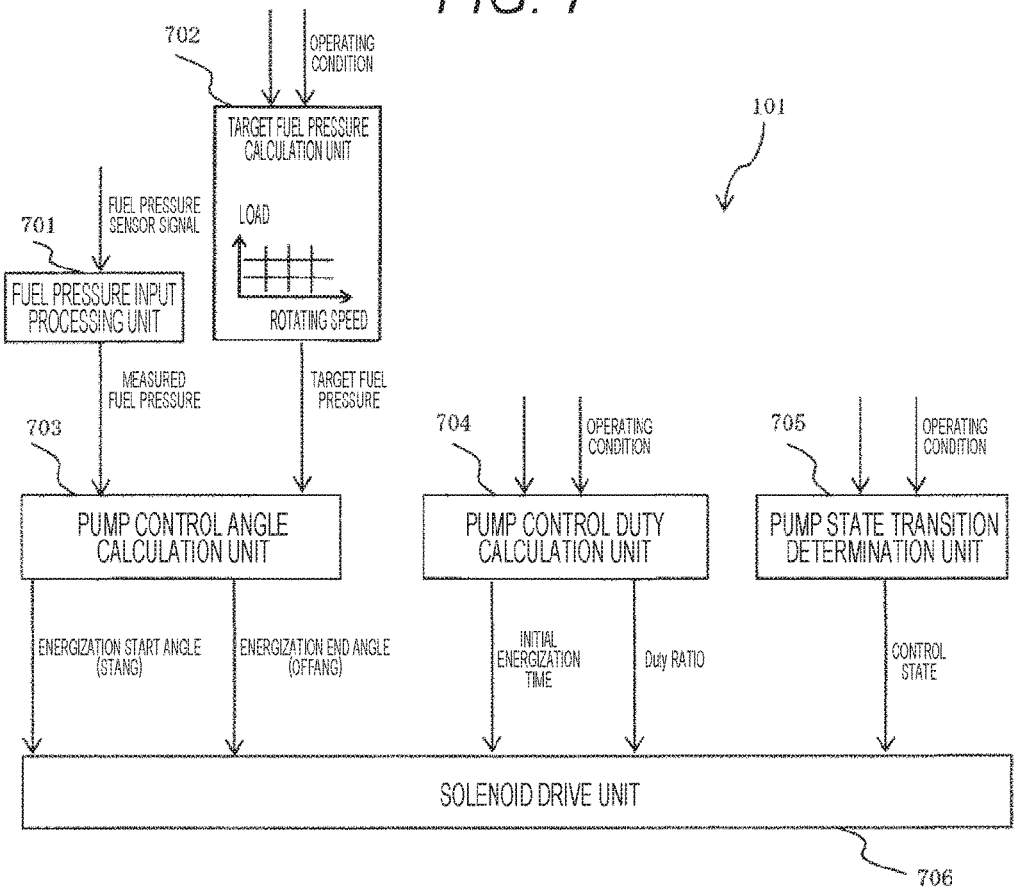
FIG. 7 is a block diagram for illustrating control of the internal combustion engine control unit shown in FIG. 1.

Next, with reference to FIG. 7, the function of the internal combustion engine control unit 101 will be described. FIG. 7 is a block diagram for illustrating the control of the internal combustion engine control unit 101 shown in FIG. 1.

The internal combustion engine control unit 101 includes a fuel pressure input processing unit 701, a target fuel pressure calculation unit 702, a pump control angle calculation unit 703, a pump control duty calculation unit 704, a pump state transition determination unit 705, and a solenoid drive unit 706.

The fuel pressure input processing unit 701 conducts filter processing for the signal from the fuel pressure sensor 204 and outputs the actual fuel pressure (measured fuel pressure) to the pump control angle calculation unit 703. The target fuel pressure calculation unit 702 calculates an optimum target fuel pressure for the operating point from the engine speed and the load, and outputs the calculated target fuel pressure to the pump control angle calculation unit 703. On the basis of the input values from the fuel pressure input processing unit 701 and the target fuel pressure calculation unit 702, the pump control angle calculation unit 703 calculates a phase parameter (energization start angle, energization end angle) for controlling the discharge flow rate of the high-pressure fuel pump 108, and outputs the calculated phase parameter to the solenoid drive unit 706.

The pump control duty calculation unit 704 calculates a parameter (initial energization time, duty ratio) of a duty signal as a pump drive signal on the basis of the operating condition (engine state quantity), and outputs the calculated duty signal parameter to a solenoid drive unit 706. The pump state transition determination unit 705 determines the state of the cylinder injection engine 1, and outputs the determined state (control state) to the solenoid drive unit 706 in order to shift the pump control mode. On the basis of input values from the pump control angle calculation unit 703, the pump control duty calculation unit 704, and the pump state transition determination unit 705, the solenoid drive unit 706 supplies a current generated from the duty signal to the electromagnetic valve solenoid 301.

Next, the operation of the present embodiment will be described with reference to FIGS. 3, 4 and 5.

The period during which the piston plunger 305 is descending is the intake stroke. When the piston plunger 305 passes through the top dead center, the volume of the fuel pressurizing chamber 303 increases due to the downward movement of the piston plunger 305, and the pressure decreases. The valve closing force of the fuel intake valve 310 due to the pressure of the fuel pressurizing chamber 303 disappears and a valve opening force due to the differential pressure is generated.

At this time, since the current value of the electromagnetic valve solenoid 301 is maintained at zero or near zero, no magnetic attractive force is generated and the plunger rod 308 continues to bias the fuel intake valve 310 in the valve-opening direction and starts moving together therewith in the valve-opening direction. The plunger rod 308 is formed as a separate member from the fuel intake valve 310, but moves together with the fuel intake valve 310 in the valve-opening direction.

The period while the piston plunger 305 is ascending is the pressurizing stroke. When the piston plunger 305 is at the bottom dead center position, the fuel pressurizing chamber 303 is filled with fuel, and the electromagnetic valve solenoid 301 is in a non-electricity supplied state. The plunger rod 308 biases the fuel intake valve 310 in the valve-opening direction by the biasing force of the plunger rod biasing spring 313.

When the piston plunger 305 starts to ascend, the electromagnetic valve solenoid 301 maintains a non-electricity supplied state for a predetermined period in accordance with the operation state of the engine. While the fuel intake valve 310 is maintained in the open valve state, the fuel sucked into the fuel pressurizing chamber 303 is spilled (overflowed). The longer the spilling period is, the smaller the flow rate that the pump compresses is. The internal combustion engine control unit 101 adjusts the amount of fuel that the high-pressure fuel pump compresses by adjusting the length of this fuel spill period.

For transition from the spilled state to the pressurized state, the internal combustion engine control unit 101 supplies the electromagnetic valve solenoid 301 with electricity. The current flowing through the electromagnetic valve solenoid 301 rises with a delay due to the solenoid inherent inductance. As the current increases, the magnetic attractive force also increases, and when the magnetic attractive force becomes larger than the biasing force of the plunger rod biasing spring 313, the plunger rod 308 starts to move. When the plunger rod 308 strikes a fixed core 316, the plunger rod 308 completes its movement.

The valve closing command current to be applied to the electromagnetic valve solenoid 301 is set so that the magnetic attractive force becomes larger than the biasing force of the plunger rod biasing spring 313, but if an excessive current is applied more than necessary, excessive heat is generated. In the present embodiment, a current control circuit is applied to reduce the amount of heat generation. On the other hand, even when the current control circuit is not used, the same effect can be obtained when the timing at which the predetermined current will be reached is set in advance and the current supply amount is subjected to duty control.

Here, the internal combustion engine control unit 101 functions as a first control unit for applying a first current to the electromagnetic valve solenoid 301 in order to close the fuel intake valve 310.

When the plunger rod 308 is drawn toward the fixed core 316, the intake valve 310 is disengaged from the plunger rod 308. Therefore, the intake valve 310 starts to move in the valve-closing direction by the biasing force of the intake valve biasing spring 315 and the fluid force generated by the fuel flow.

The intake valve 310 comes into contact with the valve seat 312 to establish the valve closing state. At this time, the engagement of the plunger rod 308 with the intake valve 310 is completely released, and a gap is formed between the tip of the plunger rod 308 and the bottom flat portion of the intake valve 310.

Since the intake valve 310 and the plunger rod 308 are formed as separate members, when the moving speed of the plunger rod 308 is higher than the moving speed of the intake valve 310, the plunger rod 308 and the intake valve 310 may be separated in some cases. On the other hand, when the movement speed of the plunger rod 308 is relatively slow, the plunger rod 308 may move together with the intake valve 310.

Subsequently, as the piston plunger 305 rises, the volume of the fuel pressurizing chamber 303 decreases, and the pressure in the fuel pressurizing chamber 303 rises as shown in the pressurization stroke period (P) in FIG. 5. When the pressure in the fuel pressurizing chamber 303 becomes higher than the pressure of the fuel discharge port 304, the fuel discharge valve 306 opens and the fuel is discharged from the fuel discharge port 304.

When a driving current is applied to the electromagnetic valve solenoid 301 at a certain timing during the compression stroke, the intake valve 310 is closed, the fuel in the fuel pressurizing chamber 303 is pressurized and discharged toward the fuel discharge port 304. When the timing of applying the drive current to the electromagnetic valve solenoid 301 is earlier, the volume of the pressurized fuel is larger, and when the timing is later, the volume of the pressurized fuel becomes smaller. Thus, the internal combustion engine control unit 101 can control the discharge flow rate of the high-pressure fuel pump 108 by controlling the timing of closing the intake valve 310.

In the region where the plunger rod 308 is moving in the valve-closing direction or where the movement has finished, the supply current can be reduced to a current value lower than the valve closing command current. Since the plunger rod 308 is moving in the valve-closing direction or has finished its movement, the magnetic gap between the opposing faces of the fixed core 316 and the plunger rod 308 has become narrow. Thus, with a current value lower than the valve closing command current value, a larger magnetic attractive force is generated and the plunger rod 308 can be drawn in the valve-closing direction. At this time, it is sufficient that the current value is equal to or greater than the degree that the plunger rod 308 can be attracted and held (generally referred to as holding current). As a result, heat generation of the solenoid and the power consumption can be reduced.

Subsequently, while the pressure in the fuel pressurizing chamber 303 is high, the drive current of the electromagnetic valve solenoid 301 is lowered to zero. Thereby, the magnetic attractive force generated between the opposing faces of the fixed core 206 and the anchor 207 disappears, and then the plunger rod 308 starts moving toward the intake valve 310 by the biasing force of the plunger rod biasing spring 313 and travels until colliding with the bottom flat portion of the intake valve 310.

At this time, since the pressure in the fuel pressurizing chamber 303 is high, a high pressure is applied to the intake valve 310, which does not open even if the plunger rod 308 collides therewith. That is, the plunger rod 308 travels only a distance equivalent to the gap existing before the start of movement and collides with the intake valve 310. When the intake valve 310 and the plunger rod 308 collide with each other in this state, a noise due to a collision sound is generated, which causes discomfort to the driver and the like.

Figure 8:
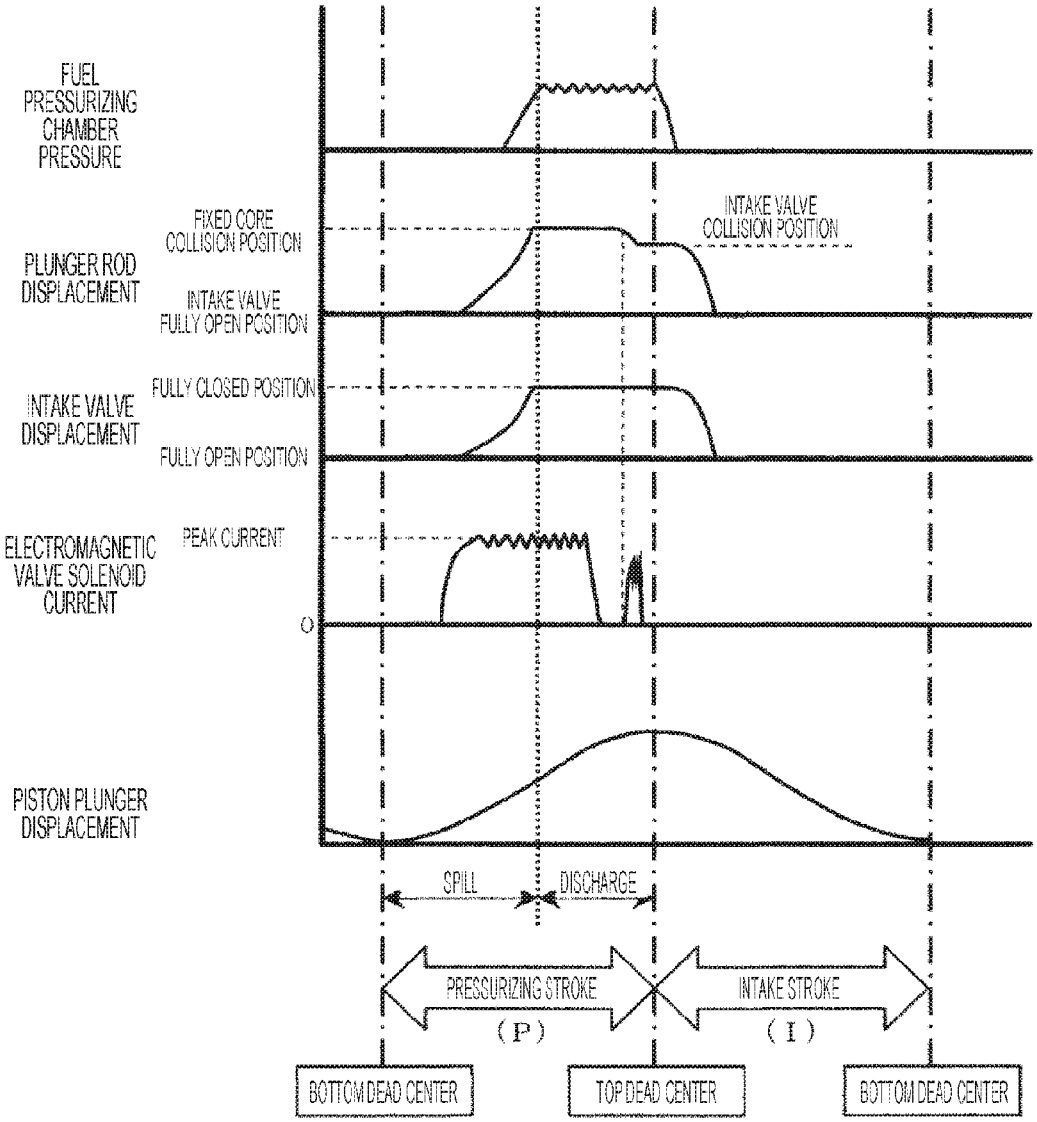
FIG. 8 is an operation timing chart of a high-pressure fuel pump used in a high-pressure fuel supply device for an internal combustion engine according to an embodiment of the present invention.

Next, a characteristic operation of the high-pressure fuel pump 108 will be described with reference to FIG. 8. FIG. 8 is an operation timing chart of the high-pressure fuel pump 108 used in the high-pressure fuel supply device of the internal combustion engine according to the embodiment of the present invention.

When the plunger rod 308 starts to move, a current having a value lower than the valve closing command current is supplied to the electromagnetic valve solenoid 301. That is, the internal combustion engine control unit 101 functions as a second control unit that applies the second current to the electromagnetic valve solenoid 301 before the plunger rod 308 collides with the fuel intake valve 310 by the biasing force of the plunger rod biasing spring 313 (elastic member). As an example, the timing at which the second current is applied is the timing when a predetermined time has elapsed since the valve closing command current (first current) is cut off. The predetermined time is set on the basis of experimental values and the like.

Then, a magnetic attractive force is generated between the opposing faces of the fixed core 316 and the plunger rod 308, and the speed of the plunger rod 308 moving in the valve-opening direction is lowered. Thereby, the speed at which the blunger rod 308 collides with the fuel intake valve 310 can be reduced. As a result, the noise generated when the blunger rod 308 collides with the fuel intake valve 310 can be reduced.

Here, if the value of the supplied current is too large, instead of weakening the force of the plunger rod 308, the force moves the plunger rod 308 in the valve-closing direction on the contrary. Hence, the value of the current to be supplied needs to be a somewhat low value. As a guide, it is desirable that it is at least lower than the peak current of the valve closing command current. That is, the current value of the second current is smaller than the peak current value indicating the maximum value of the valve closing command current (first current).

Further, as shown in FIG. 8, the internal combustion engine control unit 101 functions as a third control unit that cuts off the valve closing command current (first current) and that sets the current of the electromagnetic valve solenoid 301 to zero. This makes it easier for the plunger rod 308 to separate from the fixed core 316 when the current is cut off. In addition, power consumption of the electromagnetic valve solenoid 301 can be suppressed.

Since the control method described above is particularly effective in the idling state of the vehicle where quietness is especially required, the control method may be applied only under specific conditions such as the idling state.

According to the present embodiment, the collision speed of the plunger rod 308 during the intake process can be reduced, and the collision noise of the plunger rod 308 can be accurately reduced.

First Modification Example

In the present modification, the internal combustion engine control unit 101 (position detecting unit) detects the position of the plunger rod 308.

To be specific, for example, the internal combustion engine control unit 101 stores information on the relationship between time and the position (displacement) of the plunger rod 308 when the current shown in FIG. 8 is applied in the built-in memory (storage device) of the internal combustion engine control unit 101. The internal combustion engine control unit 101 (position detecting unit) detects the position of the plunger rod based on the measured value of the current of the electromagnetic valve solenoid 301.

The internal combustion engine control unit 101 applies the second current to the electromagnetic valve solenoid 301 before the position of the plunger rod 308 reaches the collision position indicating the position where the plunger rod 308 and the fuel intake valve 310 collide with each other. To be more specific, for example, when the position of the plunger rod 308 is within a predetermined distance from the collision position, the internal combustion engine control unit 101 applies the second current to the electromagnetic valve solenoid 301.

In the present modification example, the relationship shown in FIG. 8 is stored in the internal memory of the internal combustion engine control unit 101, but the relationship may be stored in the external memory (storage device).

Second Modification Example

In the present modification example, the internal combustion engine control unit 101 (estimating unit) detects an inflection point from the measured value of the voltage of the electromagnetic valve solenoid 301 with the elapse of time after cutting off the valve closing command current (first current), and estimates the position of the plunger rod 308 at the time of the inflection point as the collision position.

Figure 9:
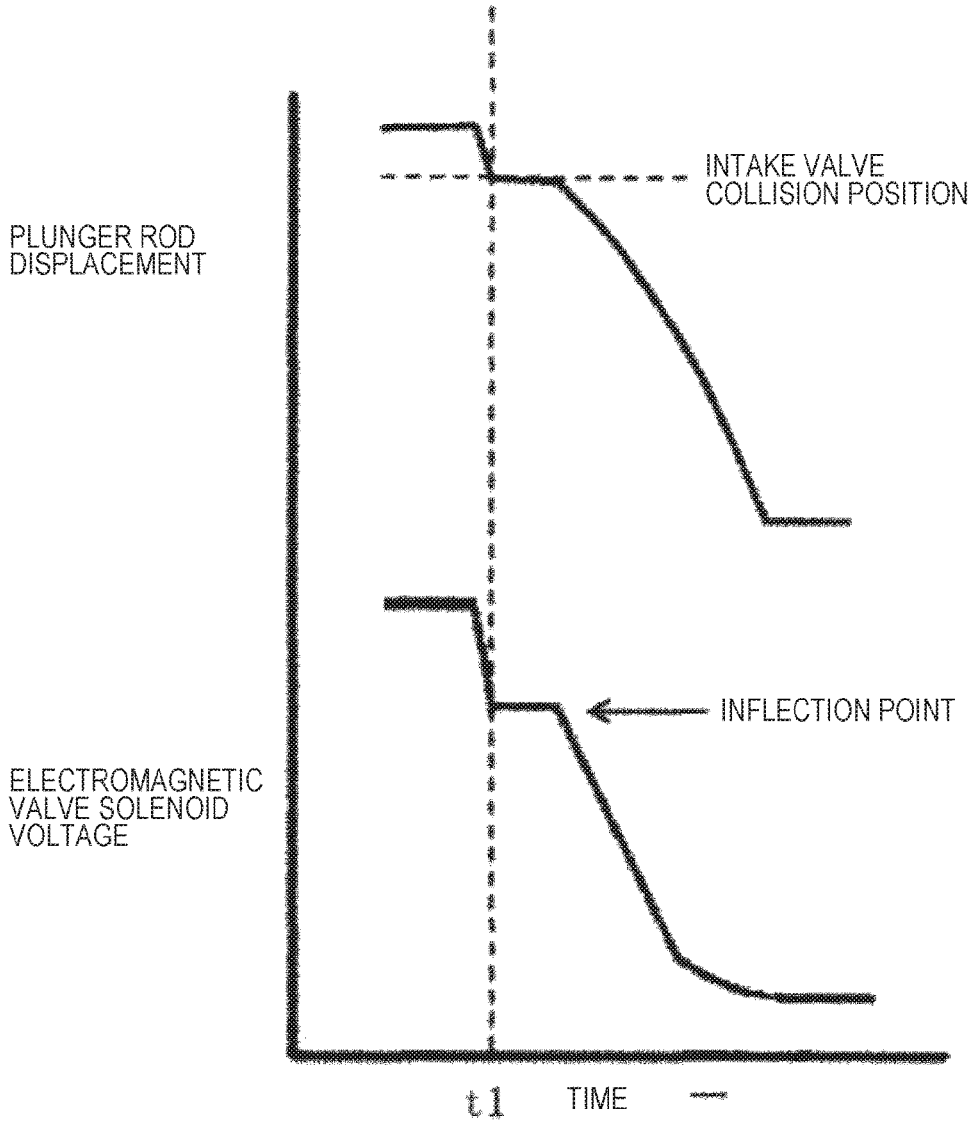
FIG. 9 is a diagram showing the relationship between the displacement of a plunger rod and the voltage of the electromagnetic valve solenoid over the lapse of time.

Here, the relationship between the inflection point of the voltage and the collision position will be described with reference to FIG. 9. FIG. 9 is a diagram showing the relationship between the displacement of the plunger rod 308 and the voltage of the electromagnetic valve solenoid 301 over the lapse of time.

When the plunger rod 308 collides with the fuel intake valve 310, the acceleration of the plunger rod 308 suddenly changes. Due to this, the magnetic resistance of the electromagnetic valve solenoid 301 changes abruptly.

When the magnetic resistance suddenly changes, the magnetic flux of the electromagnetic valve solenoid 301 changes abruptly. As a result, an inflection point appears in the voltage of the electromagnetic valve solenoid 301.

That is, as shown in FIG. 9, the position (displacement) of the plunger rod 308 at the time t1 of the inflection point can be estimated as the collision position.

The internal combustion engine control unit 101 determines the timing of applying the second current by using the estimated collision position. To be more specific, for example, when the position of the plunger rod 308 is within a predetermined distance from the estimated collision position, the internal combustion engine control unit 101 applies the second current to the electromagnetic valve solenoid 301.

Although the collision position is estimated based on the inflection point of the voltage of the electromagnetic valve solenoid 301 in the present modification example, the collision position may be estimated based on the inflection point of the current of the electromagnetic valve solenoid 301.

Further, the timing of applying the second current may be determined by using the estimated statistical values of the collision position (average value, median value, mode, etc.).

Third Modification Example

In the present modification example, the internal combustion engine control unit 101 reduces (lowers) the second current as the temperature correlated with the speed of the intake valve increases. That is, the current value of the second current is corrected according to the temperature correlated with the speed of the intake valve.

Here, the temperature correlated with the speed of the intake valve is, for example, the temperature of the cooling water, the temperature of the lubricating oil, or the temperature of the fuel.

Fourth Modification Example

Figure 10:
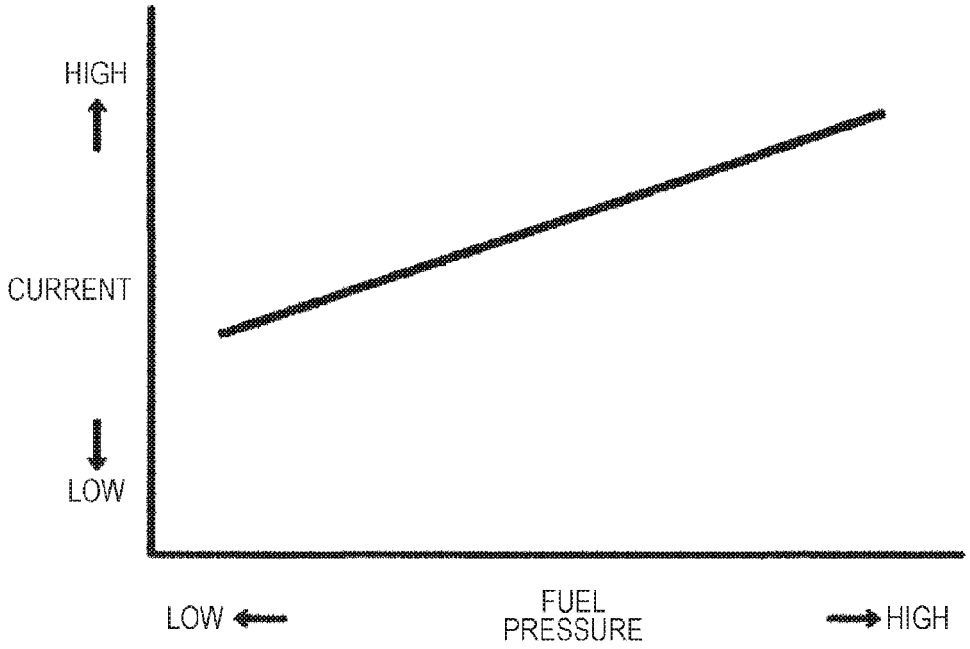
FIG. 10 is a diagram showing the relationship between a fuel pressure and a second current applied to the electromagnetic valve solenoid before the plunger rod collides with the fuel intake valve.

In the present modification example, as shown in FIG. 10, the internal combustion engine control unit 101 increases (raises) the second current as the fuel pressure increases. That is, the current value of the second current is corrected according to the fuel pressure.

It is because the speed at which the plunger rod 308 moves from the position of FIG. 6B to the position of FIG. 6C changes in accordance with the fuel pressure around the plunger rod 308.

Fifth Modification Example

Figure 11:
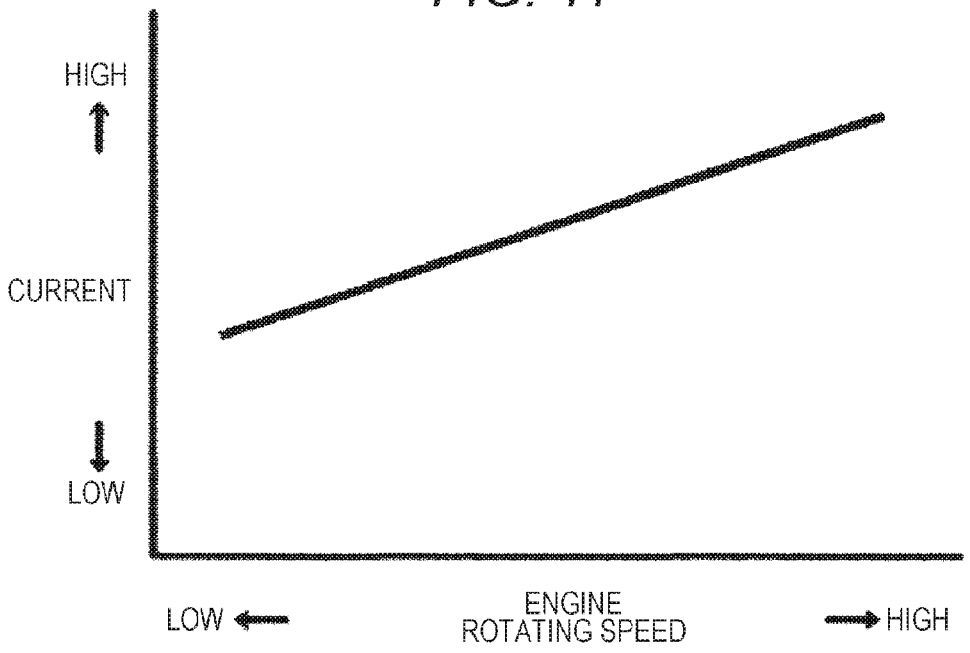
FIG. 11 is a diagram showing the relationship between an engine speed and the second current applied to the electromagnetic valve solenoid before the plunger rod collides with the fuel intake valve.

In the present modification example, as shown in FIG. 11, the internal combustion engine control unit 101 increases (raises) the second current as the engine speed increases. That is, the current value of the second current is corrected according to the engine speed.

It is because the controllable time becomes relatively shorter as the engine speed becomes higher, and thus a large current needs to be applied in a short time.

It should be noted that the present invention is not limited to the above-described embodiments, but includes various modification examples. For example, the above-described embodiments have been described in detail in order to describe the present invention in an easily comprehensible manner, and are not necessarily limited to those having all the described configurations. In addition, a part of the configuration of an embodiment can be replaced by a configuration of another embodiment, and further to a configuration of an embodiment, a configuration of another embodiment can be added. Moreover, addition of another configuration, deletion, and replacement can be carried out with respect to a part of the configuration of each embodiment.

REFERENCE SIGNS LIST

1 cylinder fuel injection type internal combustion engine
101 internal combustion engine control unit (control device)
101*a* LSI for I/O
101*a*-1 A/D converter
101*a*-2 drive circuit
101*b* CPU
102 air cleaner
103 air flow sensor
104 electrically controlled throttle valve
105 intake pipe
106 combustion chamber
107 throttle sensor
108 high-pressure fuel pump
109 fuel injection valve (injector)
110 ignition coil
111 ignition plug
115 crankshaft
116 crank angle sensor
117 common rail
118 intake air temperature sensor
119 intake valve
120 cam shaft
121 cam angle sensor
122 exhaust valve
123 exhaust pipe
124 cylinder
125 piston
125*a* piston crown surface
126 catalyst
127 fuel tank
128 low-pressure fuel pump
129 catalyst
202 water temperature sensor

203 air-fuel ratio sensor
204 fuel pressure sensor
205 oil temperature sensor
207 knock sensor
301 electromagnetic valve solenoid
300 electromagnetic valve
302 fuel intake port
303 fuel pressurizing chamber
305 piston plunger
304 fuel discharge port
306 fuel discharge valve
307 pump drive cam
309 lifter
311 valve housing
313 plunger rod biasing spring
308 plunger rod
310 fuel intake valve
312 valve seat
314 valve stopper
315 fuel intake valve biasing spring
316 fixed core

The invention claimed is:

1. A high-pressure fuel supply device for an internal combustion engine comprising:

a high-pressure fuel pump including an intake valve, a plunger rod which is formed as a separate element from the intake valve, an elastic member which biases the plunger rod in a valve-opening direction of the intake valve, and a solenoid which draws the plunger rod in a valve-closing direction of the intake valve when supplied with electricity; and a control device including a first control unit which applies a first current to the solenoid during a pumping cycle to close the intake valve, and a second control unit which applies a second current to the solenoid during the pumping cycle: i) at a predetermined time that is after a time at which the first current reaches a current value of zero, and ii) before the plunger rod collides with the intake valve during the pumping cycle due to biasing force of the elastic member, wherein a current value of the second current is smaller than a maximum value of the first current, and the entire second current is supplied before a piston plunger, which pressurizes a fuel, reaches a top dead center position during the pumping cycle.

2. The high-pressure fuel supply device for an internal combustion engine according to claim 1, wherein the control device further comprises a third control unit which cuts off the first current and which sets a current of the solenoid to zero.

3. The high-pressure fuel supply device for an internal combustion engine according to claim 1, wherein the control device further comprises a position detecting unit which detects a position of the plunger rod, and the second control unit applies the second current to the solenoid before a position of the plunger rod reaches a collision position indicating a position where the plunger rod and the intake valve collide with each other.

4. The high-pressure fuel supply device for an internal combustion engine according to claim 3, wherein the position detecting unit detects the position of the plunger rod based on a measured value of a current or a voltage of the solenoid.

5. The high-pressure fuel supply device for an internal combustion engine according to claim 3, wherein the control device further comprises an estimating unit which detects an inflection point from a measured value of a voltage of the solenoid with a lapse of time after the third control unit cuts off the first current and which estimates the position of the plunger rod at a time of the inflection point as the collision position, and the second control unit determines timing of applying the second current by using the estimated collision position.

6. The high-pressure fuel supply device for an internal combustion engine according to claim 5, wherein the second control unit determines timing of applying the second current by using a statistical value of the estimated collision position.

7. The high-pressure fuel supply device for an internal combustion engine according to claim 1, wherein the second control unit decreases the second current as a temperature correlated with a speed of the intake valve increases.

8. The high-pressure fuel supply device for an internal combustion engine according to claim 7, wherein the temperature is a temperature of cooling water, a temperature of lubricating oil, or a temperature of fuel.

9. The high-pressure fuel supply device for an internal combustion engine according to claim 1, wherein the second control unit increases the second current as fuel pressure increases.

10. The high-pressure fuel supply device for an internal combustion engine according to claim 1, wherein the second control unit increases the second current as an engine rotating speed increases.

* * * * *